US005448327A

United States Patent [19]

Eeles et al.

[11] Patent Number: 5,448,327

[45] Date of Patent: Sep. 5, 1995

[54] PHOTOGRAPHIC PROCESSING APPARATUS

[75] Inventors: Alan G. Eeles, Bellingdon; Leslie J. Pummell, Rickmansworth, both of England

[73] Assignee: Eastman Kodak Company, Rochester, N.Y.

[21] Appl. No.: 226,616

[22] Filed: Apr. 12, 1994

[30] Foreign Application Priority Data

Apr. 13, 1993 [GB] United Kingdom ..... 9307504

[51] Int. Cl.[6] ..... G03D 3/08

[52] U.S. Cl. ..... 354/320; 354/321; 354/322; 354/339

[58] Field of Search ..... 354/319–324, 354/339; 134/64 R, 64 P, 122 R, 122 P; 355/27, 28, 100

[56] References Cited

U.S. PATENT DOCUMENTS

| | | | |
|---|---|---|---|
| 3,331,276 | 7/1967 | Oliver | 355/100 |
| 3,592,119 | 7/1971 | Matheson | 354/321 |
| 4,300,828 | 11/1981 | Kaufmann | 354/322 |
| 4,945,375 | 7/1990 | Nakamura et al. | 354/322 |
| 5,210,008 | 5/1993 | Wernicke et al. | 430/398 |
| 5,241,336 | 8/1993 | Glover et al. | 354/320 |
| 5,327,189 | 7/1994 | Wernicke et al. | 354/319 |

FOREIGN PATENT DOCUMENTS

| | | |
|---|---|---|
| 3423671 | 1/1986 | Germany . |
| 59-143152 | 8/1984 | Japan . |
| 62-038465 | 2/1987 | Japan . |
| 62-51542 | 3/1987 | Japan . |
| 63-143548 | 6/1988 | Japan . |
| 4-149549 | 5/1992 | Japan . |
| 1493170 | 9/1975 | United Kingdom . |
| 2062265 | 9/1980 | United Kingdom . |
| 90/08981 | 8/1990 | WIPO . |

*Primary Examiner*—D. Rutledge
*Attorney, Agent, or Firm*—Frank Pincelli

[57] ABSTRACT

It is usual for photographic material to follow a set path along which the material is transported through various processing stages in photographic processing apparatus. The apparatus is arranged so that the material is transported therethrough in one direction only, passing from one processing stage to the next in a pre-arranged sequence. However, it may be desired to re-visit a processing stage positioned upstream of the processing stage from which the material has just exited. Described herein is apparatus in which material being processed can be directed from one processing stage to any other processing stage regardless of its positioning within the apparatus. Two processing tanks (10, 20) containing processing solution (18, 28) and processing racks (11, 21) submerged therein, are connected together by means of two tracks (30, 40). Each track (30, 40) transports the material in either a forward direction or a reverse direction as indicated by arrows 32 and 42 respectively. A plurality of track portions (310, 311, 312, 313, 314, 315, 316, 317) connect each processing rack (11, 21) with the two tracks (30, 40). A plurality of switches (102, 202, 300, 302, 400, 402) are provided for directing the material either from one of the tracks (30, 40) into respective ones of the processing racks (11, 21) or from one of the processing racks (11, 21) on to one of the tracks (30, 40).

17 Claims, 3 Drawing Sheets

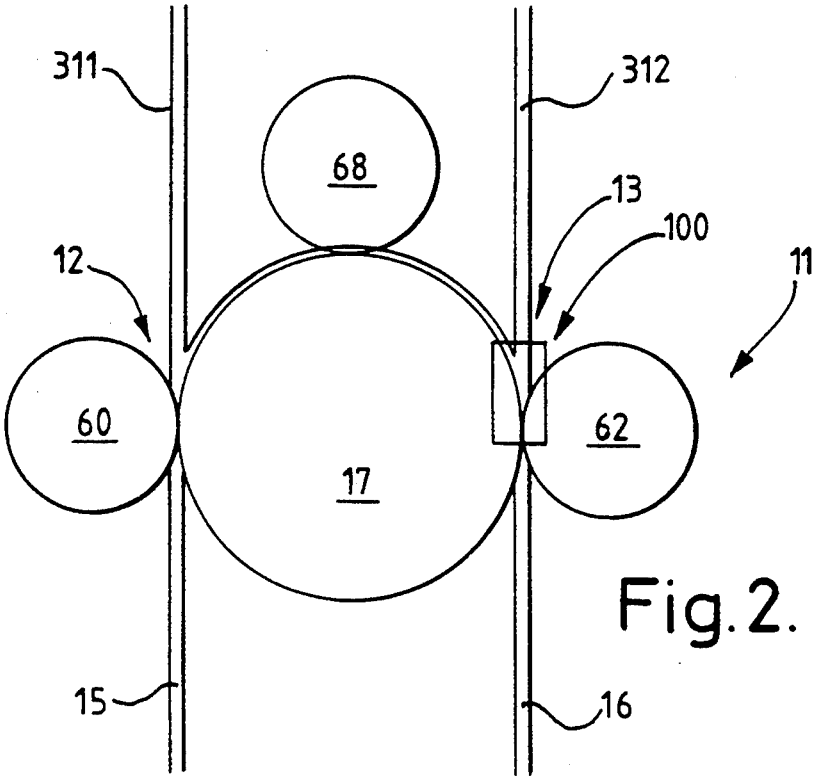
Fig.2.
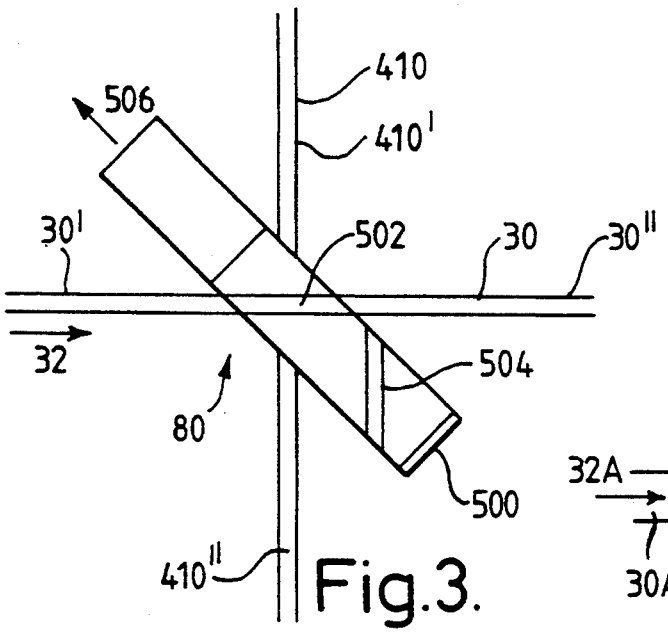
Fig.3.
Fig.4.
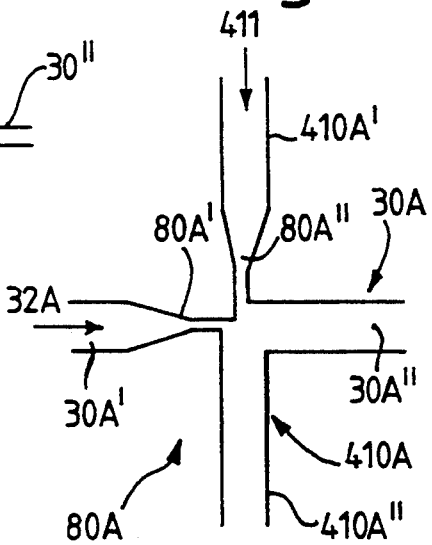

PHOTOGRAPHIC PROCESSING APPARATUS

FIELD OF THE INVENTION

The present invention relates to photographic processing apparatus and is more particularly concerned with processing apparatus in which the direction of motion of the material being processed can be reversed, that is, the material can be transported from a downstream processing tank to an upstream processing tank.

BACKGROUND OF THE INVENTION

It is usual for photographic material to follow a set path along which the material is transported through various processing stages in photographic processing apparatus. The apparatus is arranged so that the material is transported therethrough in one direction only, passing from one processing stage to the next in a pre-arranged sequence. Each processing stage is different, for example, the material is transported through the developer stage, followed by the bleach, fix, and wash stages.

EP-A-0 456 685 describes a photographic processing unit which comprises a plurality of processing stages, the material to be processed being transported through each stage to effect processing. In each of the processing stages, the material is cycled around in a given direction until treatment in that stage has been completed.

On completion of a particular treatment, the material is then switched out of that processing stage and into the next processing stage. However, the processing stages of the unit described in EP-A-0 456 685 follow a pre-arranged sequence, and it is not possible to transport the material back to a processing stage which has already been visited.

JP-A-04/149549 discloses photographic processing apparatus in which the direction of transportation of the material being processed is changed intermittently whilst the material is in a processing tank. This reciprocative movement of the material in the processing solution improves the agitation of the solution and as a result enhances the development process by eliminating irregularities in the processing.

However, it is desired, in accordance with the processing chemistry used, to pass the material through one or more processing stages for a second treatment in order to optimize the results obtained during processing. For example, it may be necessary to rinse the material being processed after each stage, that is, the material sequentially passes through the following stages: developer, rinse, bleach, rinse, fix, rinse and wash.

In current photographic processing apparatus, three separate rinsing stages as well as a wash stage will need to be provided if this sequence of stages is to be followed.

It is therefore one object of the present invention to provide photographic processing apparatus in which the material can be switched from one processing stage to any other processing stage which precedes that stage.

SUMMARY OF THE INVENTION

In accordance with one aspect of the present invention, there is provided a method of processing photographic material which comprises two or more processing steps, characterized in that the material is processed again in at least one previously visited processing step.

In accordance with another aspect of the present invention, there is provided photographic processing apparatus for processing photographic material, the apparatus comprising:

at least two processing stages, each processing stage comprising a processing tank containing processing solution and a processing rack submerged therein;

connecting means for connecting each processing stage to the other processing stages;

transport means for transporting the material around the processing rack in each processing stage and from processing stage to another along the connecting means; and control means for controlling the amount of processing given to the material, the control means including switch means operable, when in a first position, for keeping the material in the processing stage until processing in that stage is completed, and when in a second position, for switching the material out of the processing stage and on to the connecting means for transportation to another processing stage;

characterized in that the transport means is operable to transport the material from an upstream processing stage to a downstream processing stage as well as from a downstream processing stage to any processing stage upstream from that downstream processing stage under the control of the control means.

DETAILED DESCRIPTION OF THE INVENTION

In one embodiment of the invention, the connecting means comprises first and second track members arranged in parallel and positioned over the top of the processing stages, the first track member allowing transportation of the material from an upstream processing stage to a downstream processing stage and the second track member allowing transportation of the material from a downstream processing stage to any upstream processing stage. In this arrangement, a plurality of track portions are provided for connecting each processing rack with the first and second track members.

In another embodiment of the present invention, the connecting means comprises a single track member along which the material can be transported in both a forward direction from an upstream processing stage to a downstream processing stage and vice versa. In this arrangement, each processing rack is connected with the single track member by means of two track portions.

By this arrangement, greater flexibility of processing can be achieved and the number of processing stages required can be substantially reduced.

BRIEF DESCRIPTION OF THE DRAWINGS

For a better understanding of the present invention, reference will now be made, by way of example only, to the accompanying drawings in which:

FIG. 2 shows part of the FIG. 1 processing apparatus in more detail;

FIG. 3 illustrates one embodiment of an interconnection arrangement for use in the processing apparatus shown in FIG. 1;

FIG. 4 illustrates a second embodiment of an interconnection arrangement for use in the processing apparatus shown in FIG. 1.

DETAILED DESCRIPTION OF THE DRAWINGS

Apparatus constructed in accordance with the present invention can be used for processing any photographic material. However, the invention will be described in relation to the processing of photographic film.

Figure 1:
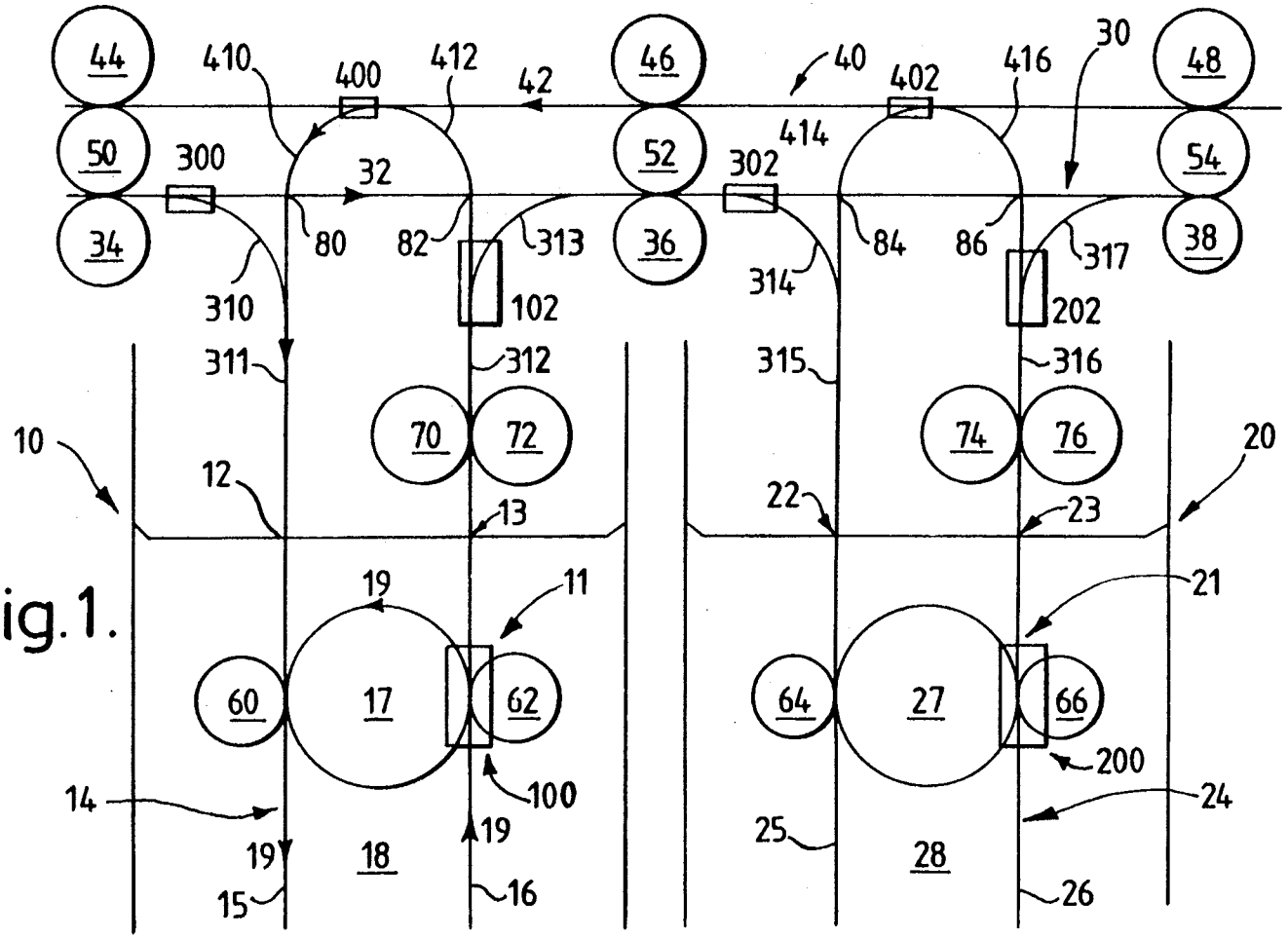
FIG. 1 is a schematic illustration of a first embodiment of processing apparatus constructed in accordance with the present invention.

Referring initially to FIG. 1, a portion of a film processing apparatus is shown. The portion comprises two processing tanks 10, 20 arranged adjacent one another. Two tracks 30, 40 connect the two tanks 10, 20 together, and also to any other tanks in the processing apparatus. Preferably, tracks 30, 40 lie in a horizontal plane across the top of the processing tanks which form the processing apparatus.

Track 30 allows movement of the film in the forward direction as indicated by arrow 32 and track 40 allows movement of the film in the reverse direction as indicated by arrow 42.

Film is transported along track 30 by roller pair 34, 50, roller pair 36, 52 and roller pair 38, 54, and along track 40 by roller pair 44, 50, roller pair 46, 52 and roller pair 48, 54. It can be readily seen that rollers 50, 52, 54 are common to both the forward track 30 and the reverse track 40. Naturally, other roller pairs may also be provided where necessary.

Each processing tank 10, 20 includes a processing rack 11, 21 along which the film is transported during processing. Racks of this type are described in EP-A-0 456 685 and comprise an inlet 12, 22 and an outlet 13, 23. A processing path 14, 24 is provided between the inlet 12, 22 and the outlet 13, 23 and is defined by vertical track portions 15, 16, 25, 26 and a pair of rollers 17, 27 (only the upper roller of each pair being shown for each processing rack 11, 21 for clarity). Each processing tank 10, 20 contains respective processing solutions 18, 28 and the racks 11, 21 are submerged therein as shown.

Rollers 17, 27 are arranged to operate in conjunction with rollers 60, 62 and 64, 66 respectively. Switches 100, 200 are positioned adjacent rollers 62, 66 respectively. The location of switch 100 in relation to roller 62 is shown in more detail in FIG. 2, but it will be readily understood that switch 200 is identically located with respect to roller 66 for rack 21.

Squeegee roller pairs 70, 72 and 74, 76 are provided along respective track portions 312, 316 to remove excess processing solution from the film prior to it being transported up on to either the forward track 30 or the reverse track 40. The provision of squeegee roller pairs 70, 72 and 74, 76 helps to prevent contamination of common track portions, and also of the next processing solution to be entered regardless of the direction of transportation of the film along tracks 30, 40.

Processing tank 10 is connected to track 30 by means of track portion 310, via switch 300, and track portion 311 on one side (inlet) and track portion 312, and track portion 313, via switch 102, on the other side (outlet). Tank 10 is also connected to track 40 by means of track portion 410, via switch 400, and track portion 311 on one side (inlet) and track portion 312 and track portion 412, via switch 102, on the other side (outlet).

Similarly, processing tank 20 is connected to track 30 by means of track portion 314, via switch 302, and track portion 315 on one side (inlet) and track portion 316, and track portion 317, via switch 202, on the other side (outlet), and to track 40 by means of track portion 414, via switch 402, and track portion 315 on one side (inlet) and track portion 316 and track portion 416, via switch 202, on the other side (outlet).

It can be readily understood that processing tank 20 operates in the same way as processing tank 10, and reference will now only to be made to processing tank 10 for simplicity.

FIG. 2 illustrates the top end of the processing rack 11 in more detail. Film enters the rack 11 at the inlet 12 along track portion 311. It is then transported through roller pair 17, 60 down along track portion 15 around lower roller of roller pair 17 (not shown) and back up track portion 16 towards the outlet 13. Here, the film passes through roller pair 17, 62, and depending on the position of switch 100, the film is either transported around roller 17 and back to down track portion 15 for further processing in tank 10 or out of rack 11 and into track portion 312 towards switch 102 (FIG. 1). Film to be further processed in solution 18 is transported along the processing path 14, that is, along track portion 15, around the lower roller of roller pair 17, along track portion 16, and around the upper roller of roller pair 17, in a counterclockwise direction as indicated by arrows 19 (FIG. 1).

Various embodiments of switches which can be used for switch 100 are described in EP-A-0 456 685.

An additional roller 68 (not shown in FIG. 1 for clarity) may be employed to retain the film against the surface of the upper roller of roller pair 17 as it is directed back through the inlet 12, through roller pair 17, 60 and into track portion 15.

Once processing is complete, as discussed above, switch 100 operates to switch the film out of that particular processing tank 10 and up on to either the track 30 for forward motion to a next successive processing tank or the track 40 for reverse motion to a previous processing tank.

As mentioned previously, tank 20 operates in the same way and switch 200 operates to switch the film out of the tank once processing is complete.

Switches 102, 202, 300, 302, 400, 402 operate on a similar principle to switches 100, 200.

In the case of switches 300, 302, these operate to switch the film off forward track 30 and into respective ones of the processing tanks 10, 20. Similarly, switches 102, 202 operate to switch the film back on to forward track 30 after processing in respective tanks 10, 20.

Switches 400, 402 operate to switch film off the reverse track 40 and into a previously visited processing tank, for example, from tank 20 to tank 10 in the case of switch 400.

Naturally, switches 400, 402 can be used to switch the film from the track 40 back into the tank from which the film has just exited if desired. For example, it may be desirable to aerate the film during the bleaching process.

It is to be noted that although the film can be transported in a reverse direction along track 40 passing from a downstream processing tank to an upstream one, the direction of transportation of the film in each processing stage is in the same direction. In this example, the direction of transportation is in a counterclockwise direction as indicated by arrows 19 in FIG. 1.

Naturally, the direction of transportation of the film may be reversed. In this case, the positioning of the switches, track portions etc. in each processing stage will be altered accordingly.

Tracks 30, 40 may also be interchanged so that track 40 becomes the forward track and track 30 the reverse track.

It will be noted from FIG. 1 that track portions 410, 412, 414, 416 cross forward track 30 at points 80, 82, 84, 86. At these points, suitable interconnections are provided. Two such interconnections are shown in FIGS. 3 and 4.

In FIG. 3, one interconnection 80 is shown. Although only one interconnection is to be described, the following is also applicable to any other interconnection 82, 84, 86.

A switch element 500 having track portions 502, 504 is positioned at the interconnection 80 between the track portion 410 and track 30. This element 500 divides track 30 into two sections 30', 30". Similarly, element 500 divides track portion 410 into two sections 410', 410". Track portions 502 and 504 formed in the switch element 500 are arranged to connect with either sections 30', 30" of track 30 and sections 410', 410" of track portion 410 respectively as desired so that the film can be transported undisturbed either in the forward direction along track 30 or in a direction transverse to that forward direction along track portion 410 respectively.

As shown in FIG. 3, track 30 is connected, track portion 502 of switch element 500 being aligned with sections 30', 30" of track 30. In this position, the film can be transported in the forward direction as shown by arrow 32.

Track portion 410 is arranged to be generally orthogonal to track 30 at the interconnection 80 as shown in FIG. 1. Connection between sections 410', 410" of track portion 410 and track portion 504 of switch element 500 is effected by movement of the switch element 500 in a direction indicated by arrow 506 to bring track portion 504 into alignment with sections 410', 410". In this position, film can be transported along track portion 410 undisturbed.

When it is desired to transport film along track 30 once again, switch element 500 is moved in the opposite direction to that indicated by arrow 506 to bring track portion 504 into alignment with sections 30', 30" as shown.

FIG. 4 illustrates another way in which the interconnections 80, 82, 84, 86 can be effected. Here, parts similar to those mentioned previously bear the same reference numerals with the addition of the suffix "A".

In FIG. 4, an interconnection 80A is shown. Track portion 410A and track 30A are divided into respective sections 410A', 410A" and 30A', 30A". However, in this interconnection 80A, no further elements are required. End 80A' of section 30A' and end 80A" of section 410A' are shaped so as to funnel the film into sections 30A" and 410A" respectively when transported in the directions indicated by arrows 32A and 411.

It is to be noted that this shaping will ensure that even curled film will be transported straight across the interconnection 80A without taking the orthogonal path. The exact nature of the shaping will be dependent on the materials from which the tracks and track portions are made.

As discussed above, the direction of transportation of the film in each processing stage may be reversed. Similarly, track 30 may be interchanged with track 40. In each of these cases, it may be necessary to re-position the interconnections 80, 82, 84, 86, 80A to ensure correct transportation of the film.

Figure 5:
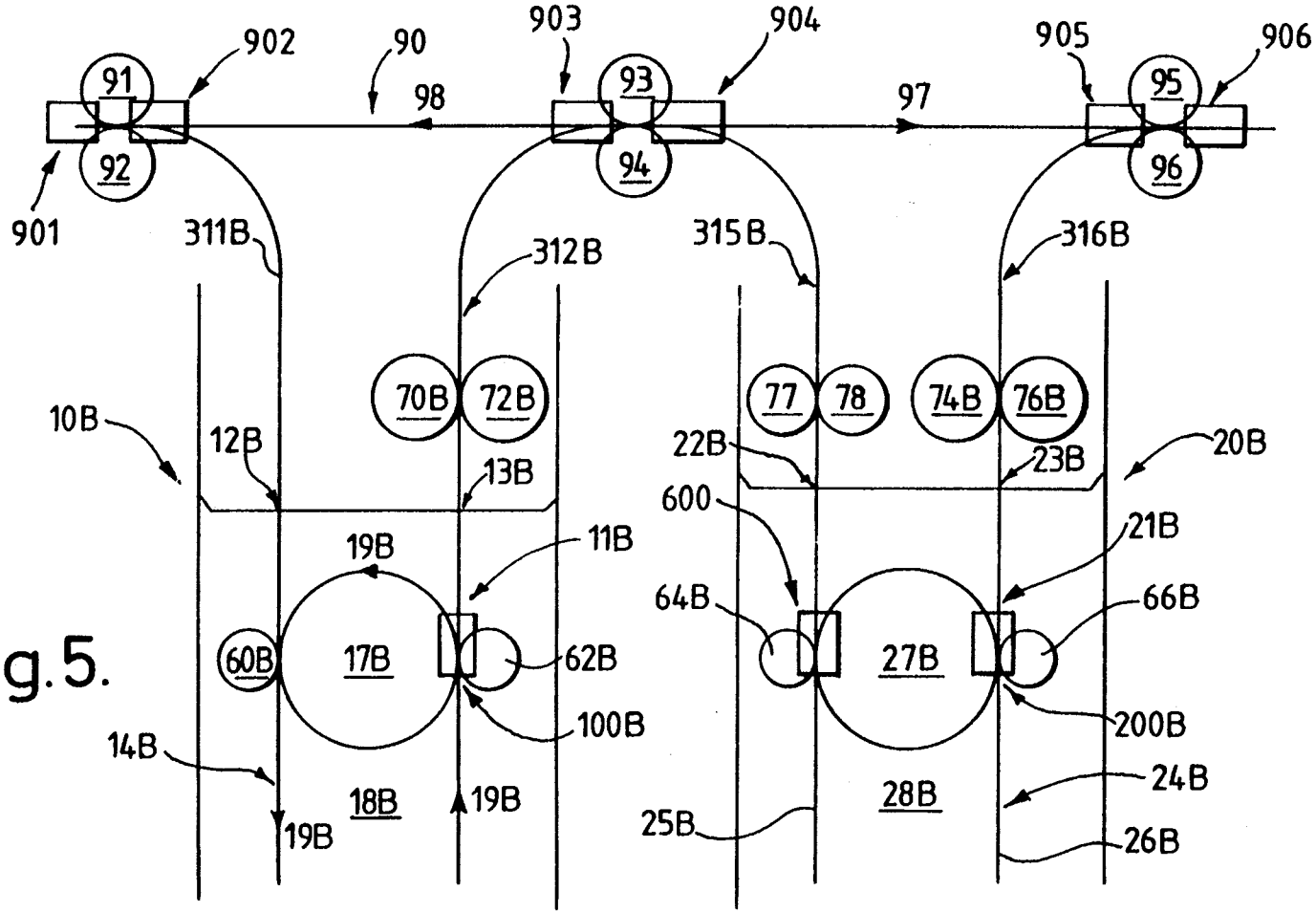
FIG. 5 is a schematic illustration of a second embodiment of the processing apparatus constructed in accordance with the present invention.

In a second embodiment of the present invention, a single top track is utilized as shown in FIG. 5. In this embodiment, the direction of transportation of the film in the processing tank is reversed. Parts similar to those mentioned previously bear the same reference numerals with the addition of the suffix "B".

In FIG. 5, a part of a processing apparatus is shown which comprises two processing tanks 10B, 20B arranged adjacent one another as before. A single track 90 connects the two tanks 10B, 20B together, and also to any other tanks in the processing apparatus. As before, track 90 lies in a horizontal plane across the top of the processing tanks which form the processing apparatus.

Film is transported along track 90 by roller pair 91, 92, roller pair 93, 94 and roller pair 95, 96. These roller pairs are driven (by means not shown) to transport the film along track 90 either in a forward direction, as shown by arrow 97, or a reverse direction as shown by arrow 98. As before, other roller pairs may also be provided where necessary.

Each processing tank 10B, 20B includes a processing rack 11B, 21B comprising an inlet 12B, 22B, an outlet 13B, 23B, and a processing path 14B, 24B therebetween. As before, the processing path 14B, 24B is defined by vertical track portions 15B, 16B, 25B, 26B and a pair of rollers 17B, 27B (only the upper roller of each pair being shown for each processing rack 11B, 21B for clarity). Each processing rack 11B, 21B is submerged in processing solution 18B, 28B as shown.

As described with reference to FIG. 1, rollers 17B, 27B are arranged to operate in conjunction with rollers 60B, 62B and 64B, 66B respectively. Switches 100B, 200B are positioned adjacent rollers 62B, 66B respectively as described above and operate in identical fashion to switches 100, 200 shown in FIG. 1.

Squeegee roller pairs 70B, 72B and 74B, 76B are provided along respective track portions 312B, 316B to remove excess processing solution from the film prior to it being transported up on to track 90 as before.

Processing tank 10B is connected to track 90 by means of track portion 311B, via switches 901, 902 on one side (inlet) and track portion 312B, via switches 903, 904 on the other side (outlet).

Similarly, processing tank 20B is connected to track 90 by means of track portion 315B, via switches 903, 904 on one side (inlet) and track portion 316B, via switches 905, 906, on the other side (outlet).

Processing tank 20B differs from processing tank 20 in that an additional switch 600 is positioned to operate in conjunction with roller pair 27B, 64B. This switch 600 operates in a similar way to switches 100, 200 to switch the film either out of the processing tank 20B by way of the inlet 22B and along track portion 315B or around upper roller of roller pair 27B and down through roller pair 27B, 66B for further processing. However, when switch 600 operates to switch the film on to track portion 315B, the direction of transportation of the film must be reversed. Preferably, this necessitates the provision of a further squeegee roller pair 77, 78 which carry out a similar function to squeegee roller pairs 70B, 72B and 74B, 76B.

Film can be transported from track 90 into tank 10B for processing, out of tank 10B and then into tank 20B as before. Furthermore, the film can be transported out of tank 20B and on to track 90 for transportation to any previously visited processing stage by carrying out the appropriate switching.

When the film is being processed in tank 20B, drive is stopped and reversed when the trailing edge of the film has passed through roller pair 27B, 64B. Switch 600 is operated to allow the film to be transported out of the processing rack 21B through inlet 22B.

In apparatus where separate racks connected by a single track are used, it is normal to use butt-faced junctions to ensure that the track is contiguous between the racks for transportation of the film in the forward direction. However, as the film has to be guided in both directions along the same track in the apparatus shown in FIG. 5, it is not possible to use the normal funneling in the track where the mouth of the downstream part of the track is wider than the mouth of the upstream part. Reversible joints may be used where interleaving fingers are provided so that the leading edge of the film regardless of the direction of transportation will never strike a guide edge.

Normally, a single drive motor is used as the prime mover. However, in this embodiment of the invention, it is important that only one film is reversed at any one time, and that priority is given to ensure that development time is optimized. Switch 600 is necessary when a single drive motor is used to prevent other films being reversed out of other processing tanks in an uncontrolled manner.

If however, each rack is independently driven by its own prime mover, for example, a stepper motor, servo-controlled ac or dc motor, or a switched reluctance motor, then the automatic reversing inlet track can be safely used.

Naturally, it is vital to ensure that both racks involved in the transfer are being driven at the same speed during transfer. Roller pairs 91, 92, 93, 94 and 95, 96 in FIG. 5 are all driven together and at a matching speed and direction to drive the film safely from tank 10B to 20B and vice versa.

Apparatus as described above allows rinsing stages to be carried out after the development or bleach stages prior to the film being transported into the next processing stage. This reduces contamination of the next solution by materials carried over from the previous solutions. This also reduces the replenishment requirements of the processing solutions utilized.

Furthermore, a single wash tank can be used where all film can be routed to that tank whenever it is to be washed or rinsed.

Redox amplification chemistry can be used where it is necessary to shuttle the film backwards and forwards between two or more tanks. For example, shuttling the film backwards and forwards between the developer and amplifier stages to improve the processing results. Similarly, film can be developed and fixed and then recycled through those two processing stages until sufficient dye intensity has been built up.

Control of processing apparatus incorporating the present invention will need to be more complicated as more than one direction of transportation of the film is implemented.

Although the present invention is described with reference to the processing of photographic materials, apparatus constructed in accordance with the present invention can be utilized in any arrangement where chemically sensitive materials are to be treated.

| Parts List: | |
|---|---|
| 10, 10B, 20, 20B | processing tanks |
| 11, 11B, 21, 21B | processing rack |
| 12, 12B, 22, 22B | inlet |
| 13, 13B, 23, 23B | outlet |
| 14, 14B, 24, 24B | processing path |
| 15, 16, 25, 26 | vertical track portions |
| 17, 17B, 27, 27B, 34, 36, 38, 44, 46, 48, 50, 52, 54, 60, 60B, 62, 62B, 64, 64B, 66, 66B, 68, 91, 92, 93, 94, 95, 96 | rollers |
| 18, 28 | processing solution |
| 19, 32, 32A, 42, 97, 98, 411, 506 | arrows |
| 30, 40, 90 | tracks |
| 30', 30", 30A, 30A', 30A", 310, 311, 311B, 312, 312B, 313, 314, 315, 315B, 316, 316B, 317, 410, 410', 410", 410A, 410A', 410A", 412, 414, 416, 502, 504 | track sections |
| 70, 70B, 72, 72B, 74, 74B, 76, 76B, 77, 78 | squeegee roller pairs |
| 80, 80A, 80A', 80A", 82, 84, 86 | points |
| 100, 100B, 102, 200, 200B, 202, 300, 302, 400, 402, 500, 600, 901, 902, 903, 904, 905, 906 | switches |

We claim:

1. Photographic processing apparatus for processing photographic material, the apparatus comprising:

at least two processing stages, each processing stage comprising a processing tank containing processing solution and a processing rack submerged therein;

connecting means for connecting each processing stage to the other processing stages;

transport means for transporting the material around the processing rack in each processing stage and one of said from processing stages to another one of said processing stages along the connecting means;

control means for controlling the amount of processing given to the material, the control means including switch means operable, when in a first position, for keeping the material in the processing stage until processing in that stage is completed, and when in a second position, for switching the material out of the processing stage and on to the connecting means for transportation to another processing stage; and characterized in that the transport means is operable to transport the material from an upstream processing stage to a downstream processing stage as well as from a downstream processing stage to any processing stage upstream from that downstream processing stage under the control of the control means.

2. Apparatus according to claim 1, wherein the connecting means comprises first and second track members arranged in parallel and positioned over the top of the processing stages, the first track member allowing transportation of the material from an upstream processing stage to a downstream processing stage and the second track member allowing transportation of the material from a downstream processing stage to any upstream processing stage.

3. Apparatus according to claim 2, wherein the connecting means further comprises a plurality of track portions connecting each processing rack with the first and second track members.

4. Apparatus according to claim 3, wherein the track portions from one of the track members cross the other of the track members at a junction.

5. Apparatus according to claim 4, wherein each junction comprises an interconnection whereby material can be transported across the junction in any of two predetermined directions.

6. Apparatus according to claim 5, wherein the two predetermined directions are generally orthogonal to one another.

7. Apparatus according to claim 5, wherein the interconnection comprises a track element having two portions positioned to lie parallel with respective ones of the two predetermined directions, each portion completing either the track member or the track portion according to the positioning of the track element.

8. Apparatus according to claim 6, wherein the interconnection comprises a track element having two portions positioned to lie parallel with respective ones of the two predetermined directions, each portion completing either the track member or the track portion according to the positioning of the track element.

9. Apparatus according to claim 7, wherein the track element is movable between a first position where the track member is completed and a second position where the track portion is completed.

10. Apparatus according to claim 9, wherein the track element is movable in a direction which is at an angle to both of the two predetermined directions.

11. Apparatus according to claim 5, wherein the interconnection comprises a four-way cross connection formed in both the track portion and the track member, the arms of the cross connection being shaped to direct material from one arm into the arm located directly opposite.

12. Apparatus according to claim 6, wherein the interconnection comprises a four-way cross connection formed in both the track portion and the track member, the arms of the cross connection being shaped to direct material from one arm into the arm located directly opposite.

13. Apparatus according to claim 2, wherein the connecting means comprises a single track member along which the material can be transported in both a forward direction from an upstream processing stage to a downstream processing stage and vice versa.

14. Apparatus according to claim 11, wherein each processing rack is connected with the single track member by means of two track portions.

15. Apparatus according to claim 1, wherein the control means further includes directing means for directing the material from the connecting means into and out of respective processing racks.

16. Apparatus according to claim 15, wherein the directing means are positioned on the connecting means.

17. Apparatus according to claim 3, wherein further directing means are positioned along the track portions connecting each rack with the second track member for directing the material on to the second track member or on to the first track member.

* * * * *